US007607964B2

(12) United States Patent
Mone et al.

(10) Patent No.: US 7,607,964 B2
(45) Date of Patent: Oct. 27, 2009

(54) FOUNDATION GARMENT

(75) Inventors: Michelle Georgina Mone, Glasgow (GB); Michael John Mone, Glasgow (GB)

(73) Assignee: MJM International Limited (GB)

( * ) Notice: Subject to any disclaimer, the term of this patent is extended or adjusted under 35 U.S.C. 154(b) by 410 days.

(21) Appl. No.: 10/903,074

(22) Filed: Jul. 30, 2004

(65) Prior Publication Data

US 2005/0064790 A1 Mar. 24, 2005

(30) Foreign Application Priority Data

Aug. 1, 2003 (GB) ..... 0318045.2

(51) Int. Cl.
*A41D 3/00* (2006.01)

(52) U.S. Cl. ..... 450/27; 450/22

(58) Field of Classification Search ..... 2/67, 2/69, 78.1–78.4, 406, 408.1; 450/22, 27, 450/15–17, 71–73, 63, 82, 94–96
See application file for complete search history.

(56) References Cited

U.S. PATENT DOCUMENTS

| | | | | |
|---|---|---|---|---|
| 2,676,321 | A * | 4/1954 | Dubner | 450/41 |
| 4,746,318 | A * | 5/1988 | Moyer | 450/155 |
| 4,983,140 | A | 1/1991 | Gimble | |
| 5,162,015 | A * | 11/1992 | Otani | 450/7 |
| 5,189,736 | A * | 3/1993 | Price | 2/69 |
| 6,000,993 | A * | 12/1999 | Erwin | 450/7 |
| 6,173,449 | B1 * | 1/2001 | Osterrath | 2/67 |
| D453,257 | S | 2/2002 | Kim | |
| D458,006 | S | 6/2002 | Kim | |
| 6,547,636 | B1 | 4/2003 | Cato | |

OTHER PUBLICATIONS

Frederick's of Hollywood, 1997 p. 45 Profile Cup Briefer Design Library-D2 box #4.
Frederick's of Hollywood, 1986 p. 37 item #C-Cire' Bodysuit Design Library-D2 box #4.
BFIA Jan. 2000 p. 8 Domani Swimsuit Design Library.
Frederick's of Hollywood, summer 2002 p. 1 swimsuit with x-back Internet search-Google catalogs.
BFIA Aug. 2001 p. 40 Body Wrap Lites Bodysuit with underwire Design Library.

(Continued)

*Primary Examiner*—Gloria Hale
(74) *Attorney, Agent, or Firm*—The H.T. Thao Law Group

(57) ABSTRACT

There is disclosed an improved foundation garment (110) comprising a multiway all-in-one foundation garment. Conventional foundation garments are unsuitable for wearing with clothes such as low cut or backless garments, as conventional strap arrangements and/or back panels usually "show", or are visible due to the cutaway nature of the clothing. Similar problems are experienced with respect to plunge or "frontless" garments. Accordingly, the present invention provides a foundation garments (130) comprising: breast support means (116) comprising first and second cups (116*a*, 116*b*), brief means (121), bridge means (152) between the first and second cups (116*a*, 116*b*), and first and second side or panel portions (154*a*, 154*b*) extending from the respective first and second cups (116*a*, 116*b*) to a respective side (156*a*, 156*b*) of the brief means (121), and wherein there is provided a gap or aperture (150) between the bridge means (152), an upper front edge (158) of the brief means (121) and respective edges (160*a*, 160*b*) of the first and second side portions (154*a*, 154*b*).

43 Claims, 17 Drawing Sheets

OTHER PUBLICATIONS

Frederick's of Hollywood, 1987 p. 59 item# M-bodysuit Design Library-D2 box #4.
Night N' Day Intimates, 1986 p. 19 item #G Design Library D2-box #4.
BFIA Mar. 2000 p. 10 TC Fine Shapewear bodysuit with thong back Design Library.
JC Penny's 2001 p. 169 swimsuit top with continous underwire Design Library.

* cited by examiner

FOUNDATION GARMENT

FIELD OF INVENTION

This invention relates to foundation garments or lingerie, and in particular, though not exclusively, to multiway all-in-one foundation garments such as undergarments.

BACKGROUND TO INVENTION

Herein the term foundation garment is intended to mean any garment providing breast support, e.g. undergarments such as brassieres (bras), or outer garments such as swimwear. The term all-in-one foundation garment is intended to mean a garment incorporating a brief means or arrangement as well as providing breast support means.

In the field of women's clothing there is a current fashion trend for garments or clothing such as dresses, tops, blouses and the like to have a low cut back, or to be "backless" (at least to some extent), and/or to be shoulderless or strapless. However, conventional foundation garments are unsuitable for wearing with clothes of these styles as conventional strap arrangements and/or back panels usually "show", or are visible due to the cutaway nature of the clothing. This has resulted in women having a wish to wear these "backless", shoulderless or strapless clothes, but if reluctant to go without breast support, having to look for alternative breast support arrangements. Such arrangements have generally involved a cup arrangement which is either itself adhesive or is attached to the breasts by adhesive means. However, these cup arrangements require a degree of skill and/or practise in order to be positioned correctly and effectively, and can lack "security" in that the wearer may not be confident that the cup arrangement will remain in place for the duration of the period for which it is worn.

A further problem created by clothing having a low cut backless design is that many conventional briefs will be visible above the line of the clothing at the base of the back.

GB 2 381 733 A also by the present Applicant, seeks to address one or more of these problems by providing a foundation garment comprising breast support means and strap means, and wherein the foundation garment is backless. The content of GB 2 381 733 A is incorporated herein by reference.

There is also a trend in ladies fashion towards low cut or plunge garments, e.g. dresses, tops, blouses and the like having substantially no covering between inner sides of each breast and an area extending down towards, and preferably below, the navel. Similar problems as described above with respect to "backless" garments are experienced with respect to such "frontless" garments.

It is an object of at least one embodiment of at least one aspect of the present invention to obviate or mitigate at least one of the aforementioned problems in the prior art.

It is a further object of at least one embodiment of at least one aspect of the present invention to seek to fulfil a need in the art.

SUMMARY OF INVENTION

According to a first aspect of the present invention there is provided a foundation garment comprising:

breast support means comprising first and second cups, brief means, bridge means between the first and second cups, and first and second side or panel portions extending from the respective first and second cups to a respective side of the brief means; and wherein there is provided a gap or aperture between the bridge means, an upper front edge of the brief means and respective edges of the first and second side portions.

The upper front edge of the brief means may be below the navel of a wearer, in use.

Preferably the respective edges of the first and second side portions are longitudinally extending. Preferably the first and second side portions are each made of a flexible fabric. Preferably the first and second side portions comprise first and second side panels respectively. Preferably there are provided first and second means for detachably attaching first and second ends of the bridge means to the first and second cups. Preferably the bridge means comprises a flexible and preferably non-elasticated material.

The foundation garment may comprise strap means. The strap means may comprise a first and possibly a second strap.

In a first embodiment of the present invention the foundation garment is backless. Herein by "backless" is meant that no part of the foundation garment is provided, in use, between the nape of the neck, the lower small of the back and outer edges of the shoulder blades of a wearer.

The breast support means may comprise at least part of a front panel.

In one arrangement the strap means comprises at least a first strap, and the first strap may be disposed relative to the breast support means so that the garment may be worn in a halter neck style.

In another arrangement the strap means may comprise a first strap and a second strap.

In said another arrangement a first end of the first strap may be attached at or near to an upper edge of the front panel and a second edge of the first strap may be affixed to a substantially vertical edge of the front panel in a position substantially below an armpit of a wearer, and further a first end of the second strap may be affixed at or near to an upper edge of the front panel and a second end of the second strap may be affixed to a vertical edge of the front panel in a position substantially below another armpit of the wearer, such that said first strap and said second strap do not cross over one another.

There may be provided means for detachably attaching the first and/or second straps to the breast support means and/or the front panel.

Conveniently the brief means may comprise a brief arrangement. The foundation garment may, therefore, be termed an "all-in-one". The brief means or arrangement may comprise a gusset means and a back panel means.

In one embodiment the foundation garment may be an undergarment. In another embodiment the foundation garment may be an outer garment, e.g. a swimming costume.

In a second embodiment of the present invention the foundation garment comprises a front panel arrangement and a strap arrangement, wherein the front panel comprises the breast support means and at least two substantially vertical edges, and wherein friction providing means are disposed at least on an inner side of each substantially vertical edge of the front panel.

In use, the friction providing means act to retain the garment relative to the flesh of the wearer so as to maintain the garment in a desired position.

Preferably the friction providing means comprises first and second lengths of silicone elastic, preferably fixed, e.g. stitched, onto inner sides of respective vertical edges.

Conveniently the friction providing means are disposed on at least an upper inside edge of the brief means.

Conveniently the friction providing means are disposed on at least an inner side of each substantially vertical edge of each cup of the breast support means.

In one arrangement the strap arrangement may comprise at least a first strap.

Conveniently in said one arrangement a first end of the first strap may be affixed at or near to an upper edge of the breast support means and a second end of the first strap may also be affixed to an upper edge of the said breast support means.

Preferably there are provided means for removably affixing said first strap to the foundation garment.

In another arrangement the strap arrangement may comprise a first strap and a second strap.

Preferably in said another arrangement a first end of the first strap may be affixed to the breast support means and a second end of the first strap may be affixed to one of the substantially longitudinal or vertical edges of the front panel arrangement, and further a first end of the second strap may be affixed to the breast support means and a second end of the second strap may be affixed to the other of the substantially longitudinal or vertical edges of the front panel arrangement.

Preferably there are provided means for removably affixing said first and second straps to the foundation garment.

In a first implementation of the another arrangement, said first strap and said second strap do not cross over one another.

In a second implementation of the another arrangement said first strap and said second strap do cross over one another.

In a third embodiment of the present invention the foundation garment comprises a front panel arrangement and a strap arrangement wherein the strap arrangement comprises a first strap and a second strap, a first end of the first strap and a first end of the second strap being attached to the front panel arrangement, and a second end of the first strap and a second end of the second strap being attached to respective sides of the front panel arrangement, such that the first strap does not cross over the second strap.

In one version said first strap and said second strap may be permanently affixed to the front panel arrangement.

However, in another preferable version there are provided means for removably affixing said first strap and said second strap to said front panel arrangement and/or said respective sides.

In an alternative strap configuration the removably affixable first strap and removably affixable second strap may be arranged such that the first strap and second strap do cross over.

Conveniently the straps may be formed of a same fabric as the front panel arrangement and the brief arrangement.

Conveniently the front panel arrangement comprises the breast support means.

Optionally each cup may be provided with padding inserts.

Conveniently, if provided, the padding inserts may be removable.

Each padding insert may be a bag at least partially filled with a silicone fluid, e.g. as disclosed in PCT/GB01/00694, also by the present Applicant, the content of which is incorporated herein by reference. The bag may be filled to around 25% to 50% and preferably around 33a % of a maximum internal volume of the bag.

Preferably, a viscosity of the silicone fluid is greater than water and/or the weight per unit volume of the silicone fluid is less than water.

Preferably, the silicone fluid has a viscosity in the range 250 to 450 $mm^2/S$, more preferably 300 to 400 $mm^2/S$ and even more preferably around 350 $mm^2/S$.

The silicone fluid may have around 95 ml of liquid (water) to 77.5 grams of silicone.

Preferably, the silicone fluid is a straight silicone fluid.

Preferably, the silicone fluid is a dimethyl silicone fluid.

Preferably, the silicone fluid is at least substantially dimethylpolysiloxane.

Such a silicone fluid (or oil) is available from Shin-Etsu Chemical Co Ltd of Japan under their product name KF-96-350cs. Shin-Etsu silicone oil KF-96-350cs is a group of dimethyl silicone oils. KF-96-350cs are clear water-write liquids. Such are colourless, transparent and odourless as well as being non-toxic, and provide insignificant changes in viscosity, e.g. with varying temperature, a high order of thermal oxidative stability, a high resistance to shear breakdown, a high compressibility, excellent water repellencey, high order of chemical and physiological inertness, and non-stick characteristics.

Conveniently the/each bag may be fabric covered.

Conveniently in one implementation the strap arrangement may be formed of a substantially clear (transparent) material.

Conveniently the brief arrangement comprises a gusset affixed to the front panel arrangement and a rear panel arrangement affixed at a first edge to the gusset, at a second edge attached to a first lower vertical edge of the front panel arrangement, and at a third edge attached to a second vertical edge of the front panel arrangement.

Conveniently an inner side of each substantially vertical edge of the front panel arrangement is provided with a friction providing means.

Conveniently an inner side of an upper edge of the rear panel arrangement is provided with another friction providing means.

Conveniently the and/or the another friction providing means are silicone elastic.

Conveniently each cup of the breast support means may be provided with an underwire arrangement.

Conveniently each cup of the breast support means may be a seam free cup. Alternatively the breast support means may be a balcony type arrangement or a plunge type arrangement.

Preferably the foundation garment is a female underwear garment. Alternatively the foundation garment is an article of female swimwear.

In a fourth embodiment of the present invention the foundation garment comprises a front panel arrangement and a strap arrangement comprising a first strap and a second strap, wherein when worn the first strap substantially encircles an acromio-clavicular joint of one side of a wearer and the second strap substantially encircles the acromio-clavicular joint of another side of the wearer.

Conveniently the first strap is arranged to substantially encircle the acromio-clavicular joint of a right hand side of the wearer by having a first end of the first strap attached at or near to a right hand side upper edge of the front panel arrangement and a second end of the first strap attached to a right hand side vertical edge of the panel at a point below an armpit of the wearer.

Conveniently the second strap is arranged to substantially encircle the acromio-clavicular joint of a left hand side of the wearer by having a first end of the second strap attached at or near to a left hand side upper edge of the front panel arrangement and a second end of the second strap attached to a left hand side vertical edge of the front panel arrangement at a point below another armpit of the wearer.

According to a second aspect of the present invention there is provided a foundation garment comprising an all-in-one garment having an open portion extending down at least a portion of a front of the garment.

According to a third aspect of the present invention there is provided a bridge means adapted for use in a foundation garment according to either of the first or second aspects of the present invention.

The bridge means may be selected, e.g. interchangeably, from one of: a flexible non-elasticated fabric, e.g. colour matched to a remainder of the foundation garment; or a flexible non-elasticated transparent material; flexible non-elasticated material including diamante detailing.

The first and/or second straps may be selected, e.g. interchangeably, from one of: a flexible fabric, e.g. colour matched to a remainder of the foundation garment; or a flexible transparent material.

According to a fourth aspect of the present invention there is provided a set of interchangeable bridge means adapted for use in or with a foundation garment according to either of the first or second aspects of the present invention.

According to a fifth aspect of the present invention there is provided a foundation garment comprising:

breast support means comprising first and second cups;

first and second straps, first ends of which are attached to the first and second cups respectively, and second ends of which are attached to first and second panel portions, respectively, and wherein there are provided first and second further straps, a first end of each further strap being attached to a respective first or second side portion of the garment provided above the second end of the respective first or second strap, and a second end of each further strap being attached to the respective first or second strap at or near the second end thereof.

Provision of the first and second further straps has been found to be beneficial in desirable positioning of the garment and avoidance of gaping side portions thereof.

Preferably there are provided means for adjusting a length of each of the first and second further straps.

Preferably there are provided means for adjusting a length of each of the first and second straps.

Preferably there are provided means for detachably attaching the first end of the first or second further straps to the first or second side portions, respectively.

Preferably the second end of the first or second further strap is provided with a loop, the respective first or second strap passing through the respective loop.

BRIEF DESCRIPTION OF DRAWINGS

These and other aspects of the present invention will become apparent from the following description when taken in combination with the accompanying drawings, in which are shown:

FIG. 1(*b*) a rear view of the foundation garment of FIG. 1(*a*) in the first configuration;

FIG. 5(*b*) a rear view of the foundation garment of FIG. 1(*a*) in the second configuration;

FIG. 6(*b*) a rear view of the foundation garment of FIG. 1(*a*) in the third configuration;

FIG. 7(*b*) a rear view of the foundation garment of FIG. 1(*a*) in the fourth configuration;

FIG. 8(*b*) a rear view of the foundation garment of FIG. 8(*a*) in the first configuration;

FIG. 10(*b*) a rear view of the foundation garment of FIG. 8(*a*) in the third configuration;

FIG. 11(*b*) a rear view of the foundation garment of FIG. 8(*a*) in the fourth configuration;

FIG. 13(*b*) a rear view of the foundation garment of FIG. 8(*a*) in the first configuration;

FIG. 14(*b*) a perspective view from the front and to one side of the foundation garment of FIG. 14(*a*) in the first configuration;

FIG. 14(*c*) a perspective view from the front and to another side of the foundation garment of FIG. 14(*a*) in the first configuration;

FIG. 14(*d*) a view from one side of the foundation garment of FIG. 14(*a*) in the first configuration;

FIG. 14(*e*) a view from another side of the foundation garment of FIG. 14(*a*) in the first configuration;

DETAILED DESCRIPTION OF DRAWINGS

Figure 1A:
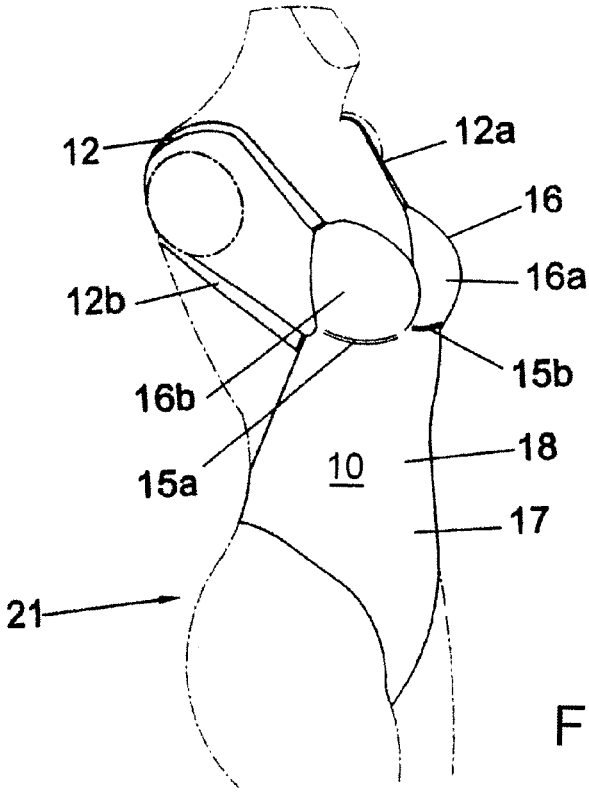
FIG. 1(*a*) a perspective view from the front and to one side of a first foundation garment falling outwith the scope of the present invention in a first configuration.
Figure 1B:
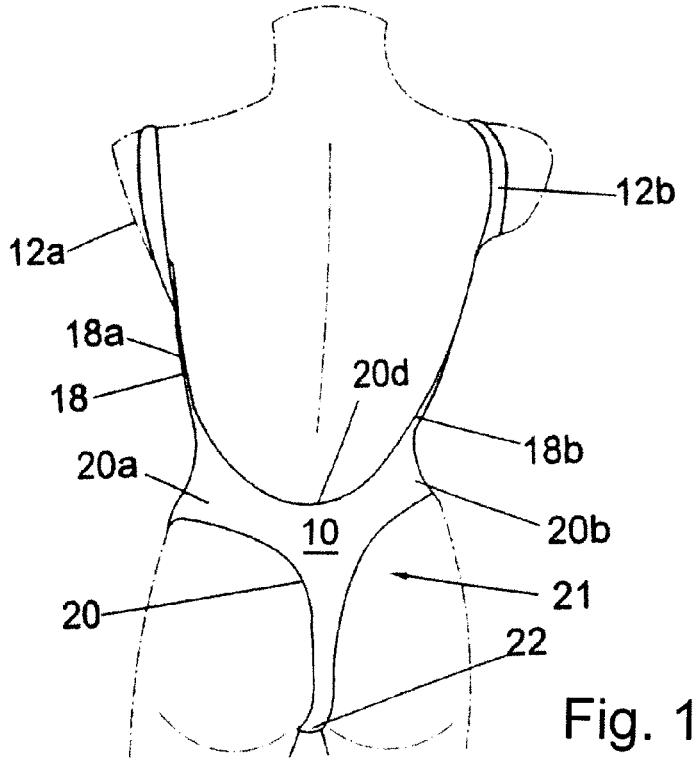

With reference initially to FIGS. 1(*a*) and 1(*b*) there is shown a first foundation garment, generally designated 10, falling outwith the scope of the present invention. The garment 10 is a multiway all-in-one undergarment arrangable in a manner which provides a wearer with an effectively "backless" garment, such as an undergarment. The foundation garment 10 comprises a front panel arrangement 18 which consists of breast support means 16 disposed at the top of a front (abdomen) panel 17, a strap means or arrangement 12 comprising a first strap 12*a* and a second strap 12*b*, and a brief arrangement 21, which is in this case is integrally formed with front abdomen panel 17. The breast support means 16 comprises a first cup 16*a* and a second cup 16*b*. In this case the cups 16*a* and 16*b* are moulded cups constructed in a seam free manner. Each cup 16*a*, 16*b* is supported on a lower edge thereof by an underwire 15*a*, 15*b*, respectively.

In order for the garment 10 to be worn in a "backless" manner the strap arrangement 12 is configured in such a way that a first end of strap 12*a* is attached to the upper edge of cup 16*a*. The strap 12*a* is, in use, directed over and behind an acromio-clavicular joint of the left shoulder of a wearer returning towards the front of the garment 10 below the left armpit of the wearer and attached to vertical edge 18*a* of the front abdomen panel 17. The strap 12*b* is similarly attached to the upper edge of cup 16*b*, directed over and behind the acromio-clavicular joint of the right shoulder of the wearer, and returning towards the front panel arrangement 18 of the garment 10 passing below the wearers other (right) armpit, and being attached to the substantially vertical edge 18*b* of the front abdomen panel 17 of front panel arrangement 18.

The brief arrangement 21 of the garment 10 is in this case configured as a thong, with a first edge 20*a* of the thong panel 20 being attached to the front abdomen panel 17 at a lower end of the substantially vertical edge 17*a* of the panel 17. A second edge 20*b* of the thong panel 20 is attached to a lower end of the substantially vertical edge 17*b* of the panel 17. The third edge 20*c* of the thong panel 20 is connected to a first end 22*a* of gusset panel 22 which is in turn attached by means of second end 22*b* to a lower edge of the front abdomen panel 17. As can be seen the thong panel 20 is constructed in such a way that only a narrow band of fabric traverses across a base back region of a wearer.

The height of the thong 20 at the back in combination with the strap configuration illustrated, ensures that no parts, e.g. fabric or straps of the garment 10, impinge on the back of the wearer in the area between the nape of the neck, the small of the back and the outer edges of each shoulder blades. Such an arrangement allows use of the foundation garment 10 with "backless" clothing items, whilst still providing the wearer with comfortable and dependable breast or bust support.

In order that during use the garment 10 provides secure and comfortable support to the wearer, an inner side of each of the substantially vertically edges 18*a* and 18*b* of the front panel arrangement 18, including the substantially vertical side edges of cups 16*a* and 16*b*, and upper edge 20*d* of the brief arrangement 21, are provided with silicone or siliconised elastic as friction providing means 24 such that the edges 18*a*, 18*b* of the garment 10 cling to the wearer and thus prevent gaping, sagging or undesirable movement of the garment 10, in use.

Figure 2:
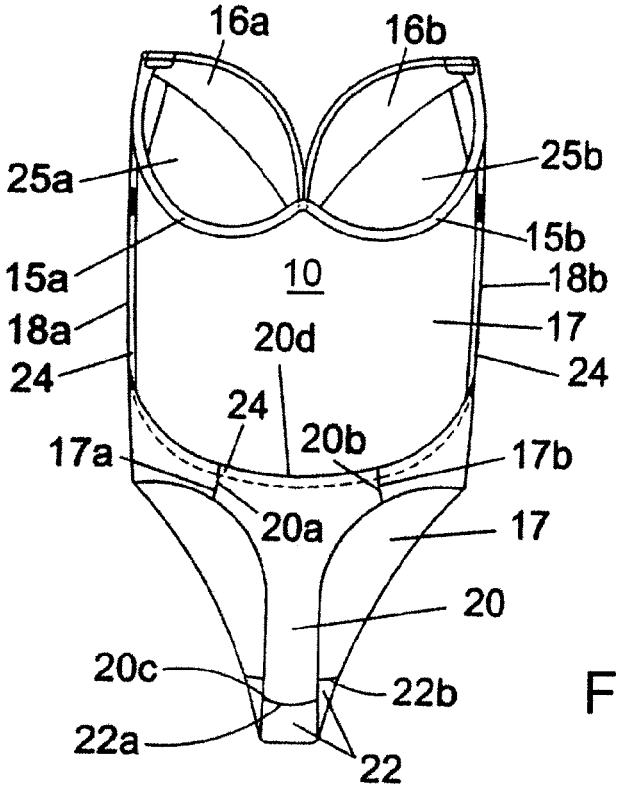
FIG. 2 a further rear view of the foundation garment of FIG. 1(*a*) with straps removed for clarity.

In FIG. 2 there is shown a back view of the foundation garment 10, with the straps 12*a*, 12*b* removed for clarity. One can see the strips of silicone elastic friction providing means 24. The silicone elastic comprises elastic coated in silicone which is stitched to the fabric of the garment 10. The strips of silicone elastic 24 are disposed at the outer limits of an inside face of the breast support means 16 and the front abdomen panel 17 or front body panel 18 (see FIG. 2), as well as at an upper edge of the brief arrangement 21 (see FIG. 3). An inner side of the front abdomen panel 17 of the garment 10 is provided with a lining fabric which in this case is a two way stretch mesh fabric. Breast support means 16 and gusset panel 22 are provided with a cotton or polycotton lining material.

It can also be seen from FIG. 2 that the cups 16*a*, 16*b* of the breast support means 16 can be provided on the inside of the garment 10 with pockets 25*a* and 25*b* respectively in which removable padding inserts can be inserted by the wearer. If desired, these inserts can be in the form of bags at least partially filled with a fluid such as a silicone gel, and in this case are in the form of bags partially filled with silicone gel which are laminated in fabric, e.g. to match the fabric of the foundation garment 10. Such bags partially filled with silicone gel are disclosed in PCT/GB01/00694 also by the present Applicant, the content of which is incorporated herein by reference.

Figure 3:
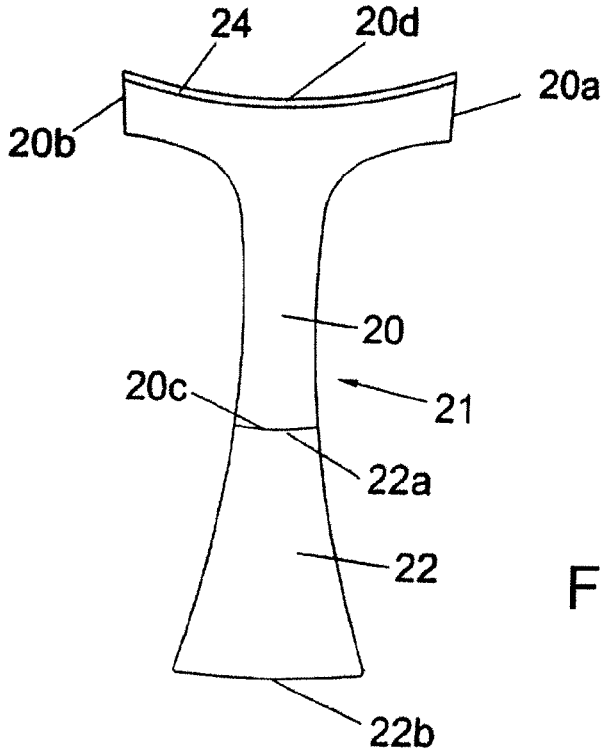
FIG. 3 a schematic representation of a brief arrangement of the foundation garment of FIG. 1(*a*)

With reference to FIG. 3 there is shown a schematic representation of the brief arrangement 21 of the garment 10. As can be seen the silicone elastic friction providing means 24 continues along an upper edge 20*d* of the thong panel 20.

Figure 4A:
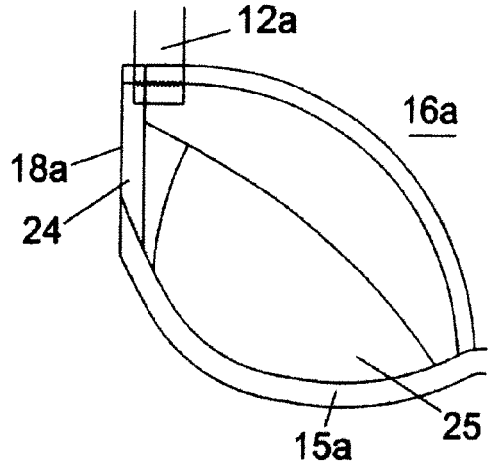
FIGS. 4(*a*), (b), (c) schematic representations of three manners in which a strap or straps may be affixed to a body of the foundation garment of FIG. 1(*a*)
Figure 4B:
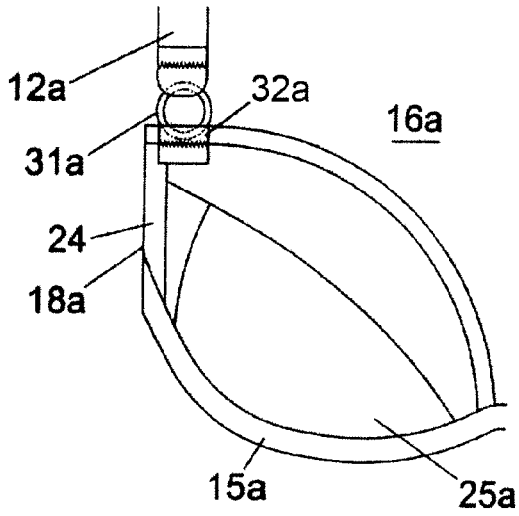
Figure 4C:
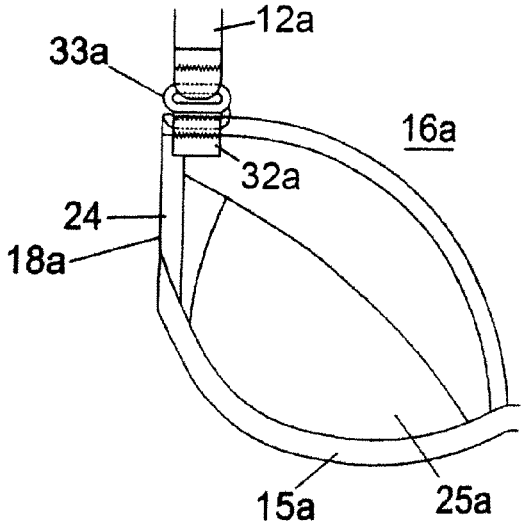

In FIGS. 4(*a*), 4(*b*) and 4(*c*) there are shown schematic representations of three manners in which the strap arrangement 12 could be affixed to the front panel arrangement 18 the garment 10. With reference firstly to FIG. 4(*a*), there is shown a close up view of cup 16*a* of the breast support means 16 in order to illustrate a first manner in which the strap 12*a* can be affixed to the garment 10. In this instance a first end of the strap 12*a* is affixed to the garment 10 permanently by being sewn to an upper edge of the cup 16*a* during construction of the garment 10.

With reference to FIG. 4(*b*) there is shown an alternative manner in which the strap 12*a* can be permanently affixed to the garment 10. In this arrangement there is provided a fabric loop 32*a* through which is threaded a plastic hoop 31*a*, wherein the fabric loop 31*a* is sewn onto an upper edge of the cup 16*a* during the garment manufacturing process. A first end of the strap 12*a* is threaded through the plastic loop 31*a* and then folded back on itself before being sewn to form a loop, thus permanently attaching the strap 12*a* to the garment 10.

With reference to FIG. 4(*c*) there is shown a third arrangement for attaching the strap 12*a* to the garment 10. In this case the method of attachment is non-permanent, thus allowing the straps 12*a*, 12*b* to be removed, and therefore, facilitating the modification or alteration of the strap arrangement 12 with which the garment 10 is provided, e.g. dependent upon the outer garment to be worn and the effect to be achieved. In this arrangement a fabric loop 32*a* is sewn to an upper edge of cup 16*a* during the construction of the garment 10. A plastic figure-of-eight hook means 33*a*, one loop of which is open and the other of which is closed, is proved. A first end of strap 12*a* is fed through the closed loop of the hook means 33*a* folded back and sewn thus permanently affixing the figure-of-eight loop 33*a* to the strap 12*a*. The open loop of the figure-of-eight hook 33*a* can then be removably fed through the loop 32*a* provided on the cup 16*a*.

Figure 5A:
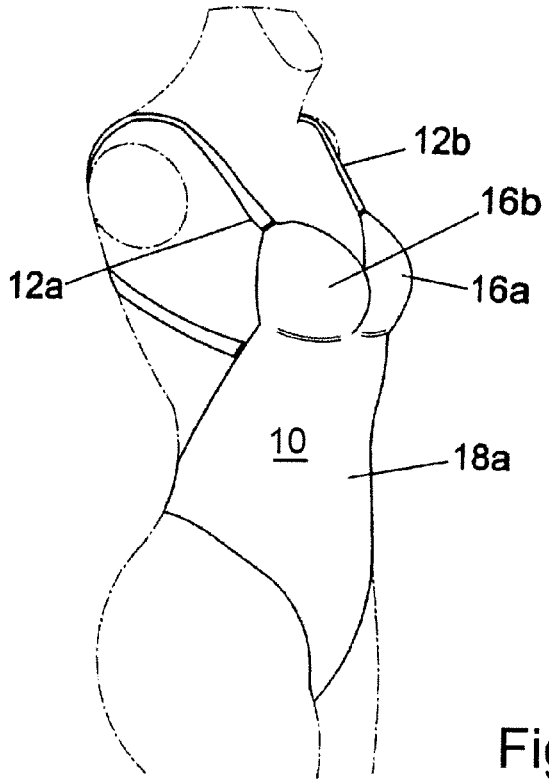
FIG. 5(*a*) a perspective view from the front and to one side of the foundation garment of FIG. 1(*a*) in a second configuration.
Figure 5B:
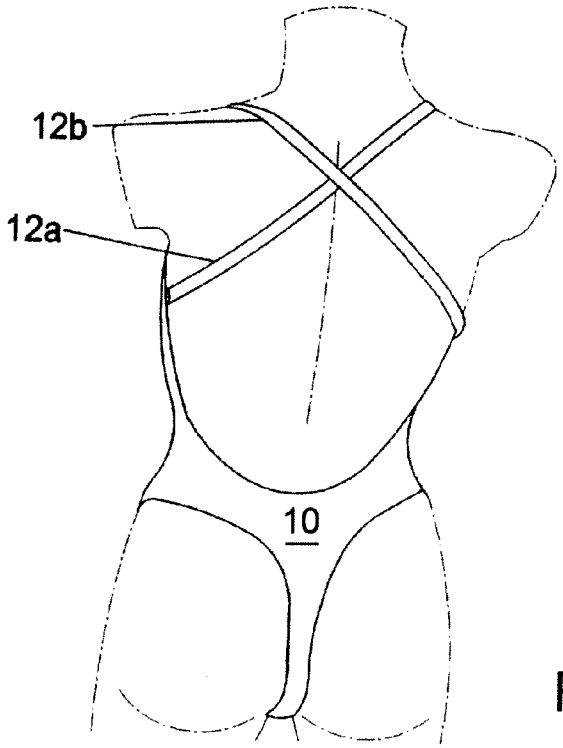

In FIGS. 5(*a*) and 5(*b*) there is shown a front perspective and a rear view, respectively, of the garment 10 in a second configuration of the straps 12*a* and 12*b* which is possible when the straps 12*a* and 12*b* are removably affixed to the garment 10 in the manner shown in FIG. 4(*c*). In this configuration the straps 12*a*, 12*b* are arranged to provide a cross over configuration with the first end of strap 12*b* being connected to a top edge of cup 16*a* and the second end of strap 12*b* being connected to the substantially vertical edge 18*b* of the front panel arrangement 18. The first end of strap 12*a* is removably attached to a top edge of cup 16*b* and the second end of strap 12*a* is removably affixed to the substantially vertical edge 18*a* of the garment 10.

Figure 6A:
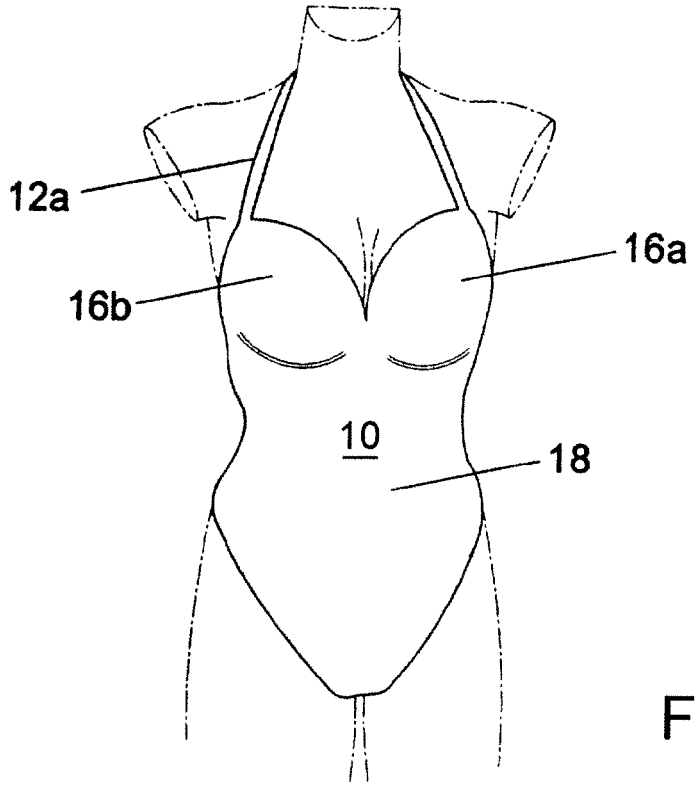
FIG. 6(*a*) a front view of the foundation garment of FIG. 1(*a*) in a third configuration.
Figure 6B:
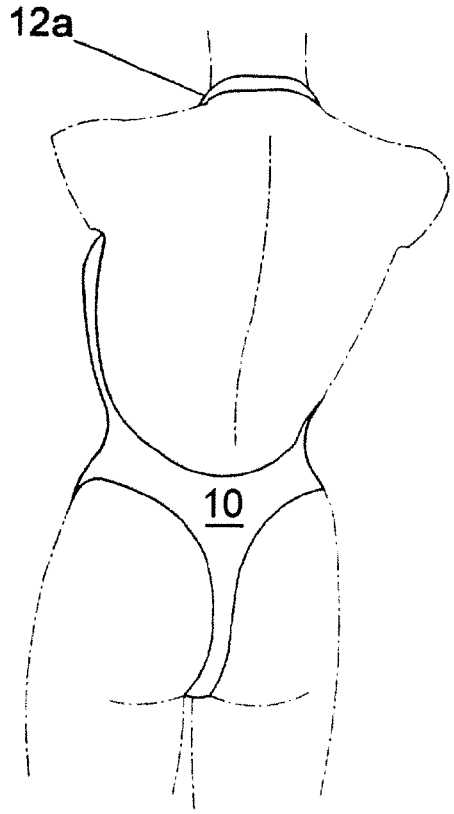

With reference to FIGS. 6(*a*) and 6(*b*) there is shown a front view and a rear view, respectively, of the garment 10 in a third strap configuration which can be provided when using removably affixable straps 12*a* and 12*b*. In this arrangement only strap 12*a* is required, such being attached to the garment 10 to provide a halter neck style configuration, with the first end of the strap 12*a* being removably affixed to the top of first cup 16*a*, and the second end of the strap 12*a* being removably affixed to the top of second cup 16*b*.

Figure 7A:
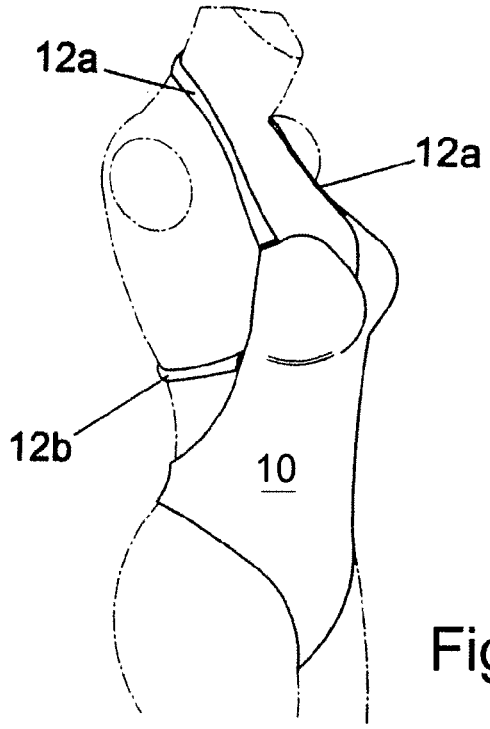
FIG. 7(*a*) a perspective view from the front and to one side of the foundation garment of FIG. 1(*a*) in a fourth configuration.
Figure 7B:
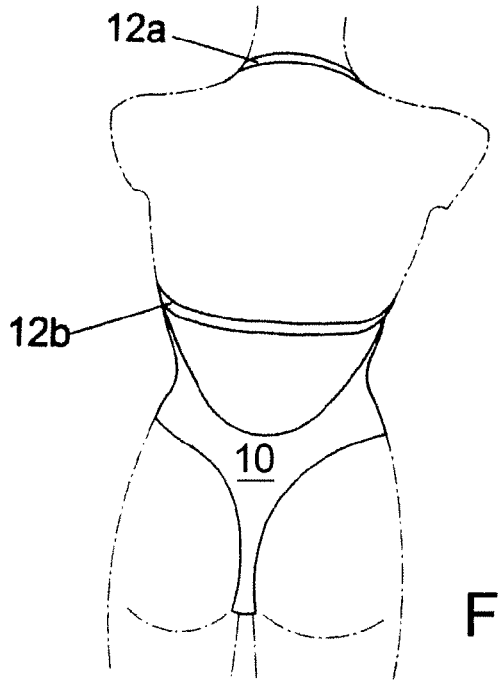

In FIGS. 7(*a*) and 7(*b*) there is illustrated a strap configuration which is similar to that of FIGS. 6(*a*) and 6(*b*). However, in this instance the second strap 12*b* is attached across the back of the user to provide additional support. In this case a first end of strap 12*a* is removably affixed to the upper edge of first cup 16*a* and the second end of strap 12*a* is removably affixed to the upper edge of second cup 16*b*. The second strap 12*b* is removably affixed at a first end to the first substantially vertical edge 18*a* of the front panel arrangement 18 and a second end of strap 12*b* is removably affixed to the second substantially vertical edge 18*b* of the front panel arrangement 18.

The appearance of the garment 10 can be further altered by the use of transparent straps which can be removably affixed to the front panel arrangement 18 by way of the arrangements hereinbefore discussed. In this case the transparent straps can be formed of PERSPEX (Trade Mark). As before the transparent straps may be permanently or removably affixed.

Figure 8A:
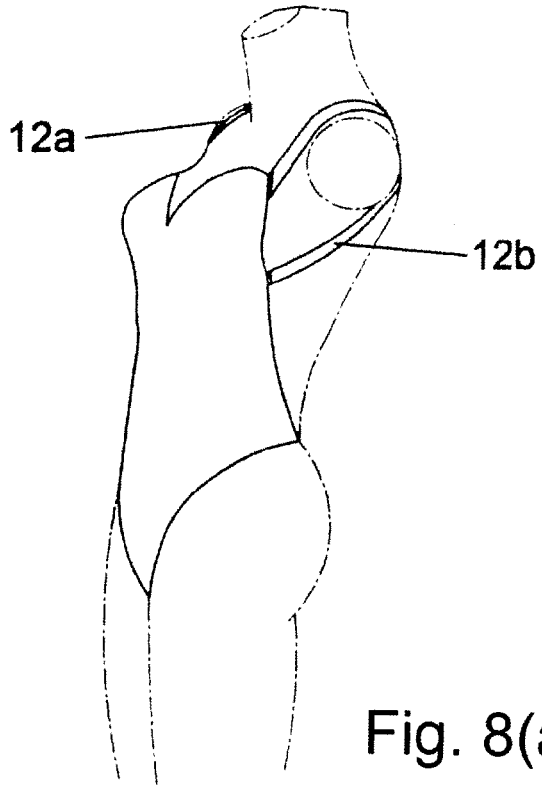
FIG. 8(*a*) a perspective view from the front and to one side of the foundation garment of FIG. 1(*a*) according to a first modification falling out with the scope of the present invention in a first configuration.
Figure 8B:
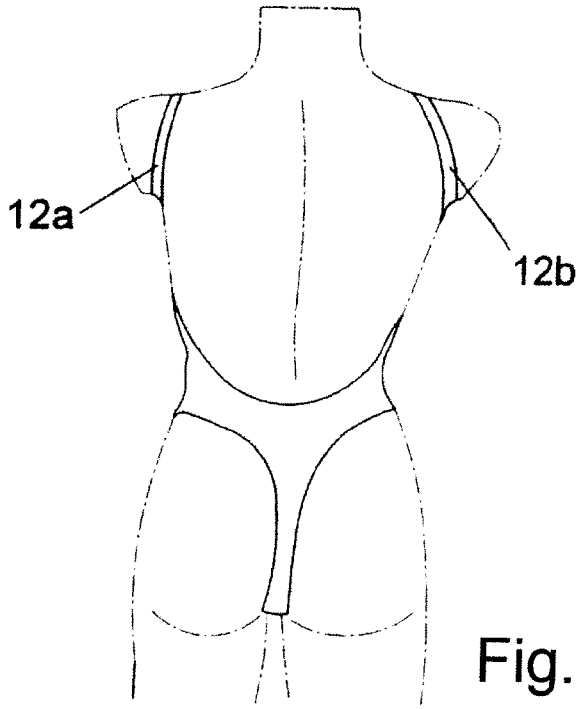
Figure 9:
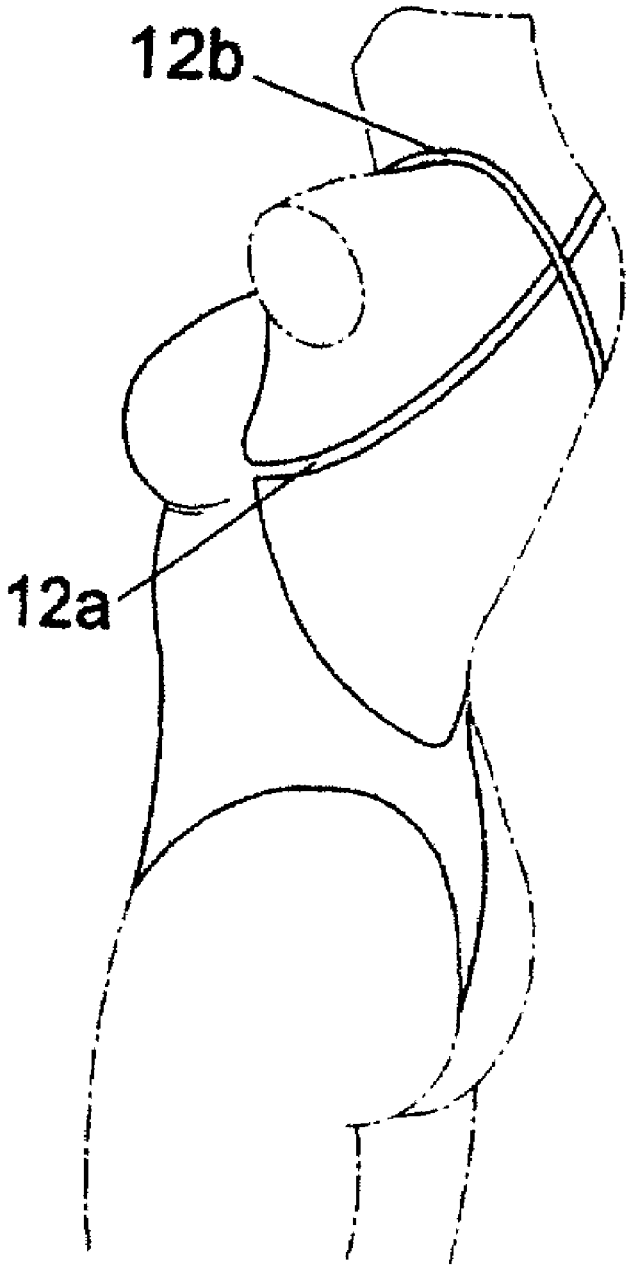
FIG. 9 a perspective view from the rear and to one side of the foundation garment of FIG. 8(*a*) in a second configuration.
Figure 10A:
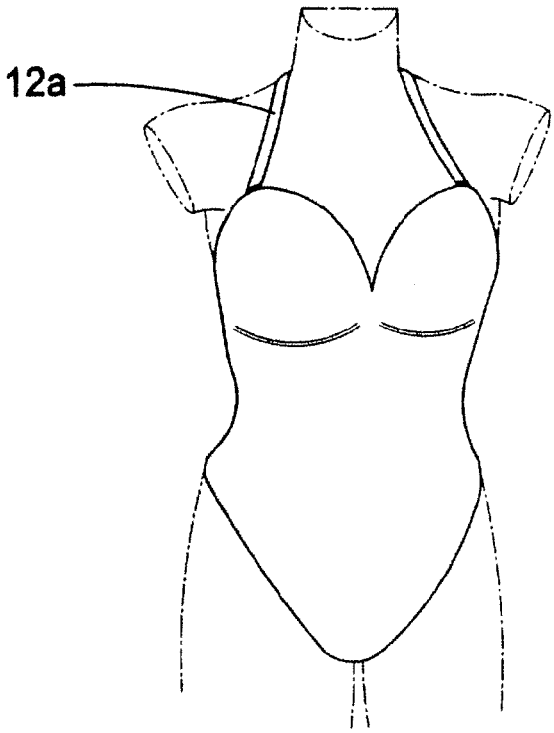
FIG. 10(*a*) a front view of the foundation garment of FIG. 8(*a*) in a third configuration.
Figure 10B:
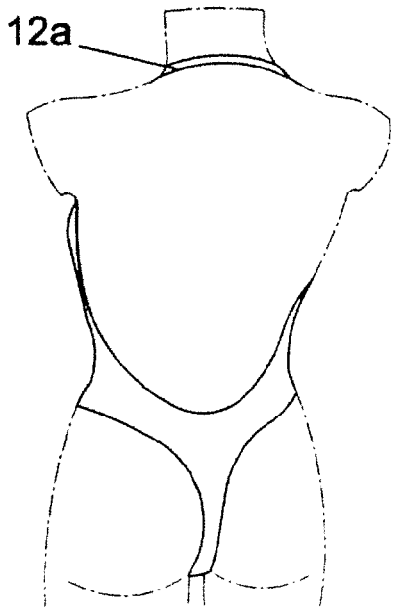
Figure 11A:
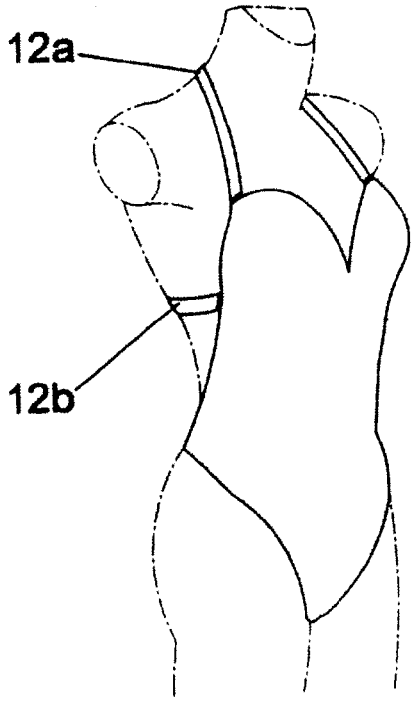
FIG. 11(*a*) a perspective view from the front and to one side of the foundation garment of FIG. 8(*a*) in a fourth configuration.
Figure 11B:
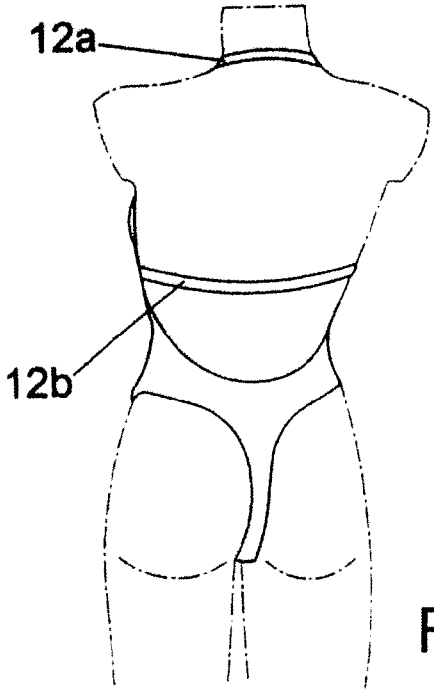

Thus, according to a first modification to this garment 10, and referring to FIGS. 8(*a*), 8(*b*), 9, 10(*a*), 10(*b*), 11(*a*), and 11(*b*), there is illustrated four strap configurations, similar to those illustrated in FIGS. 1(*a*), 1(*b*), 5(*a*), 5(*b*), 6(*a*), 6(*b*), 7(*a*), and 7(*b*) which are possible when using the removably affixed strap arrangement. However, in this modification the straps 12*a*, 12*b* used are transparent straps as described above.

The garment 10 shown in FIGS. 1 to 11(*b*) is typically constructed from a microfibre fabric for the outer layer of front abdomen panel 17 and breast support means 16, and the inner face of the front abdomen panel 17 is lined with a two-way stretch mesh fabric. The breast support means 16 and gusset panel 22 are provided with a cotton or polycotton lining material. Typically no lining is provided for the thong panel 20 at the back of the garment 10.

Figure 12:
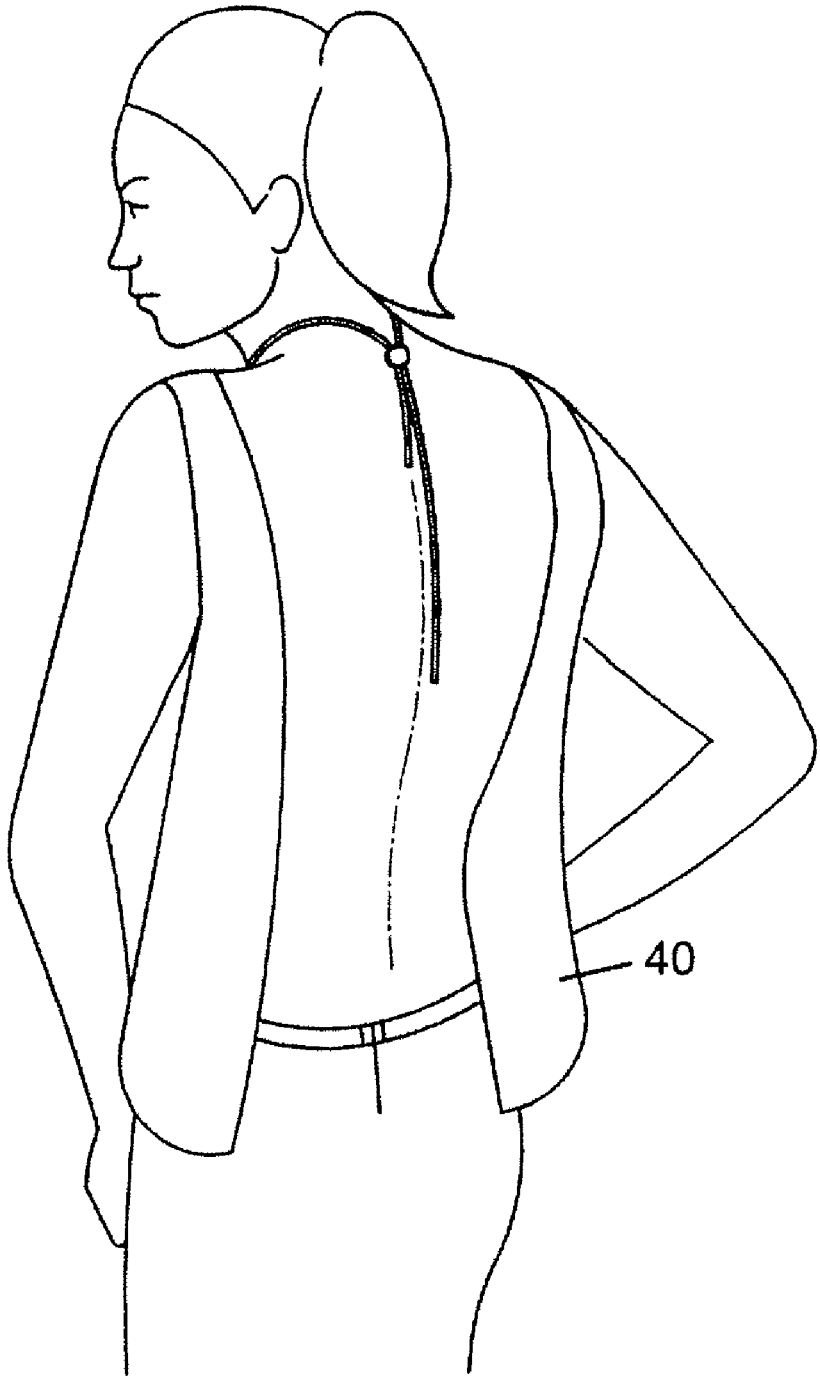
FIG. 12 a rear view of a model wearing a backless dress under which the foundation garment of FIG. 1(*a*) or FIG. 8(*a*) is worn.

In FIG. 12 there is shown a view of a model wearing a backless dress or blouse 40 under which the foundation garment 10 is worn with the straps 12*a* and 12*b* being configured in the manner shown in FIGS. 1(*a*), 1(*b*), and 6(*a*) and 6(*b*). As can be seen the construction of foundation garment 10 is such that none of the garment 10 can be seen, despite the revealing nature of the dress or blouse 40.

Figure 13A:
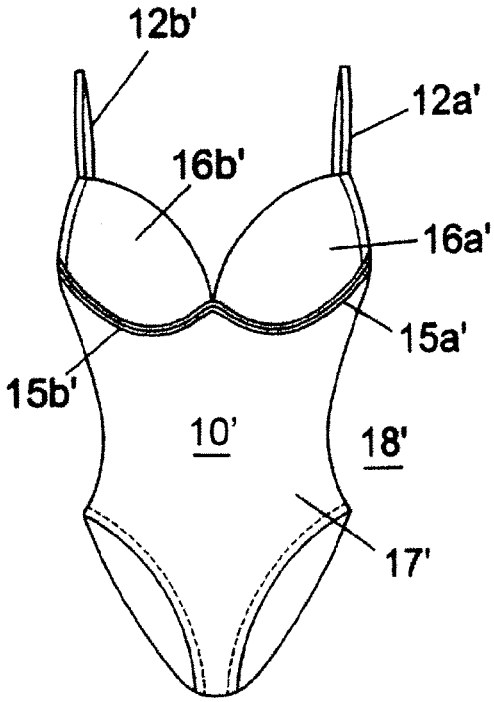
FIG. 13(*a*) a front view of a second foundation garment falling outwith the scope of the present invention in a first configuration.
Figure 13B:
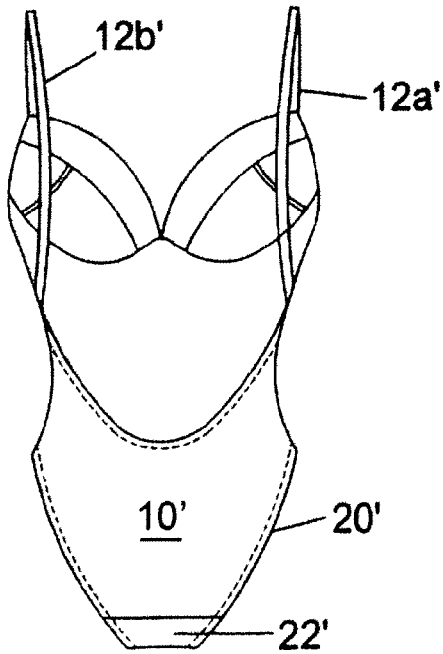
Figure 14A:
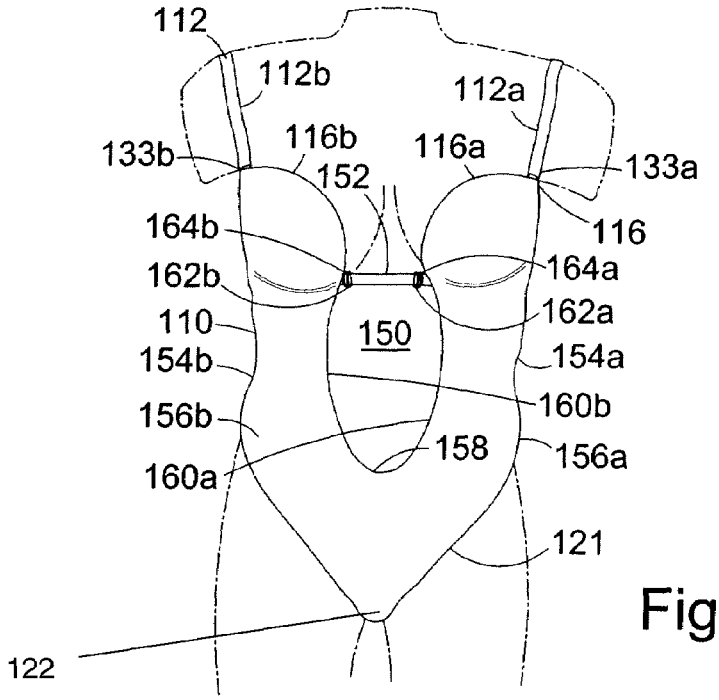
FIG. 14(*a*) a front view of a foundation garment according to a first embodiment of the present invention in a first configuration.
Figure 14B:
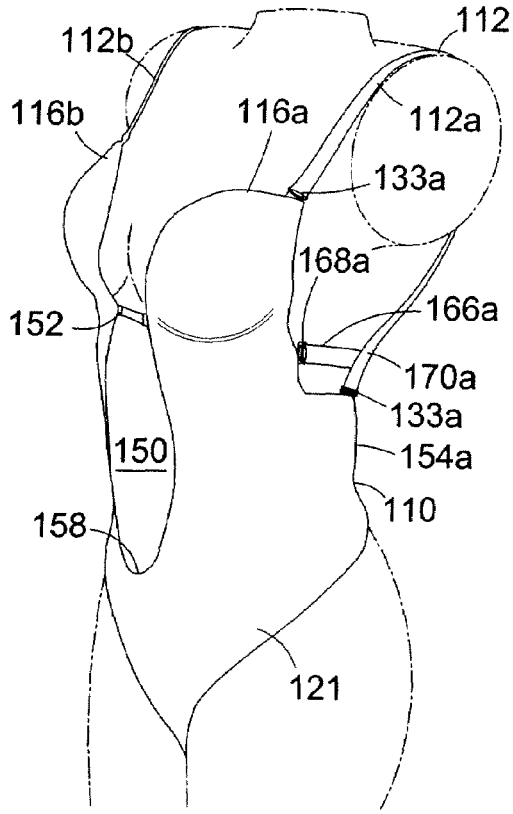
Figure 14C:
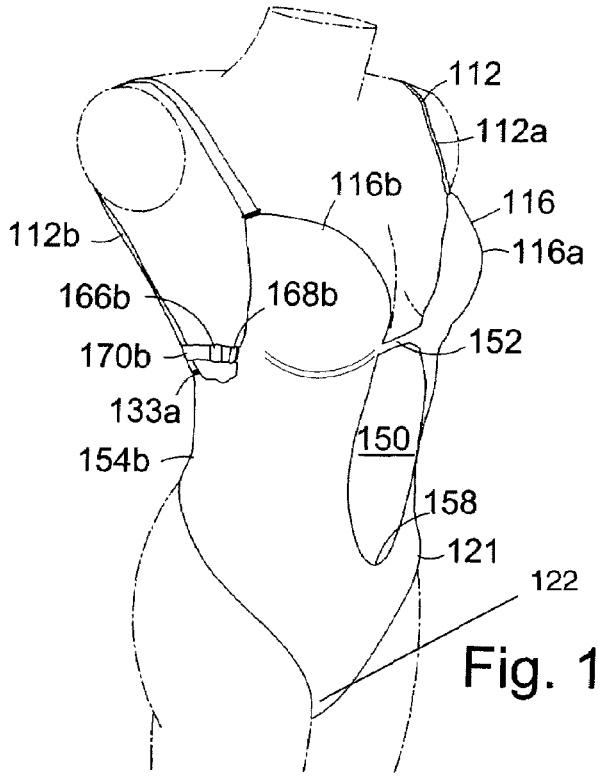
Figure 14D:
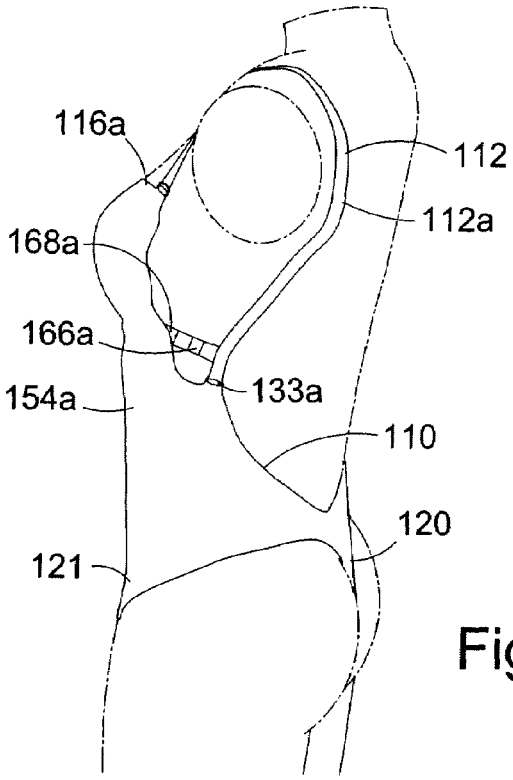
Figure 14E:
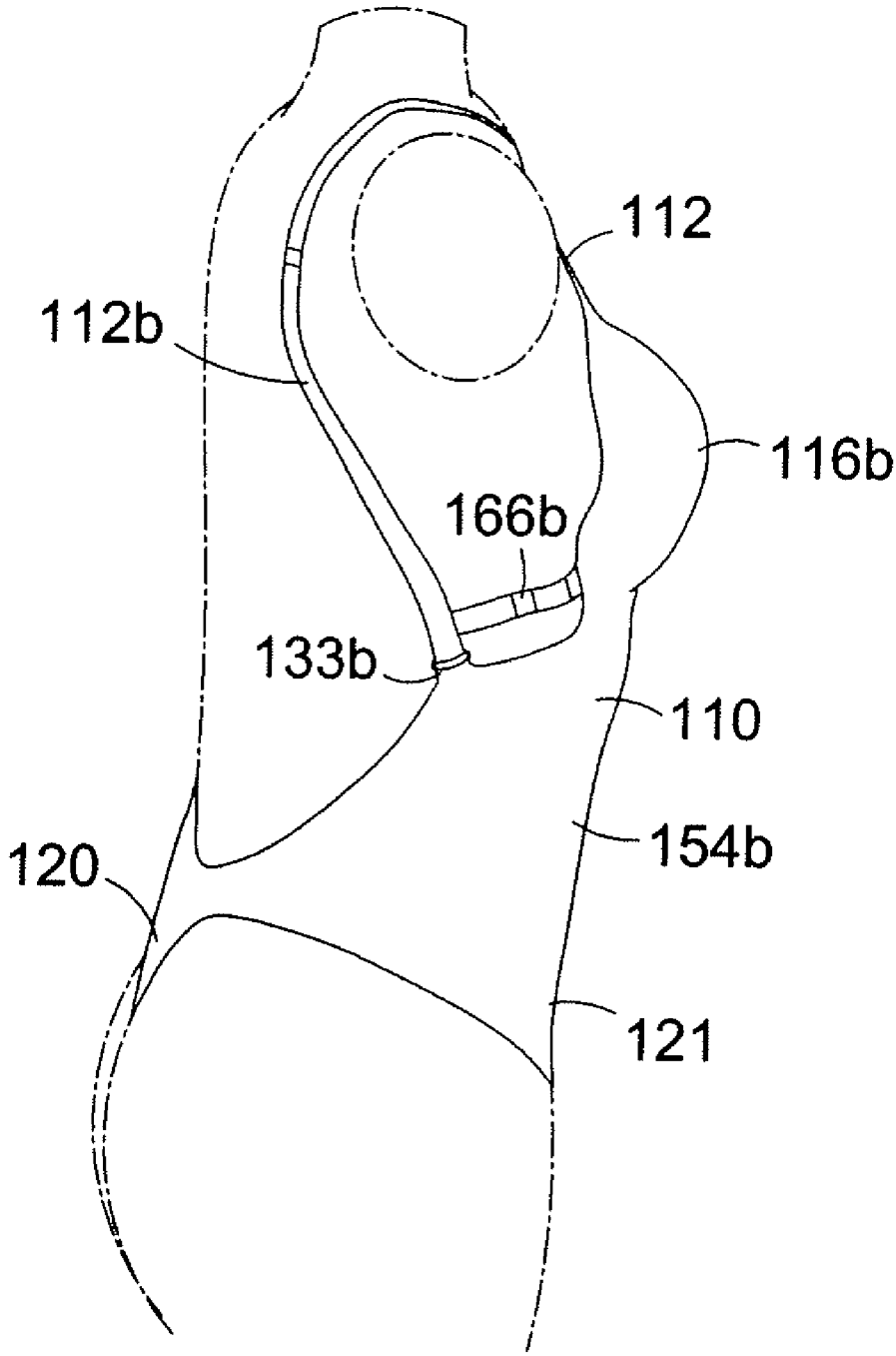

In FIGS. 13(*a*) and 13(*b*) there is shown a front view and a rear view, respectively, of a second foundation garment falling outwith the scope of the present invention constructed as a swimsuit 10' having a strap configuration allowing the garment 10' to be worn in an effectively backless fashion. Like parts are identified by like numerals to the foundation garment 10 of FIG. 1(*a*) but suffixed with a "'". In this case the brief arrangement or means 21' is formed in a full brief style. It should be noted that the straps 12*a*' and 12*b*' can be fixed as shown on FIG. 13(*a*) and (*b*) or removably attachable as in the first garment 10.

Referring now to FIGS. 14(*a*) to 14(*e*) there is shown a foundation garment, generally designated 110, according to a first embodiment of the present invention in a first configuration. The garment 110 is similar in many respects to the garments 10, 10' hereinbefore described, liked parts be identified by the numerals, but increased by "100". In particular a rear of the garment 110 (not shown) is substantially the same as the rear of garments 10, 10' hereinbefore described, as is the provision of the interchangeable strap arrangement. However, the garment 110 differs from the garments 10, 10' in that the garment 110 comprises an all-in-one garment having an open portion 150 extending down at least a portion 150 of a front of the garment 110, advantageously to below the navel of a wearer.

The foundation garment 110 comprises: breast support means 116 comprising first and second cups 11 6*a*, 11 6*b*, which comprise left and right breast cups, respectively; brief means 121 comprising gusset means 122 and comprising left and right sides 156*a*, 156*b*; bridge means 152 between the first and second cups 116*a*, 1 16*b*; and a continuous front panel, which begins at the left breast cup, extends down to a first panel portion 154*a* comprising a left front panel, and then connects to the brief means 121 at a front left side 156*a* of a brief panel, and then continues in a U-shape, and then connects at a front right side 156*b* of the brief panel to a second panel portion 154*b* comprising a right front panel, and then extends up to and ends at the right breast cup. In other words, the first and second side panel portions 154*a*, 154*b*, having respective edges 160*a*, 160*b*, extend from the respective first and second cups 116*a*,116*b* to the respective left and right sides 156*a*,156*b*of the brief means 121. The open portion or gap 150 is provided between the bridge means 152, an upper front edge 158 of the brief means 121 and respective edges 160*a*,160*b* of the first and second panel portions 154*a*,154*b*.

As can be seen from FIG. 14(*a*) the respective edges 160*a*, 160*b* of the first and second side portions 154*a*, 154*b* are longitudinally extending. The first and second side portions 154*a*, 154*b* are each made of a flexible fabric, the first and second side portions 154*a*, 154*b* comprising first and second side panels, respectively.

There are provided first and second means 162*a*, 162*b* for detachably attaching first and second ends 164*a*, 164*b* of the bridge means to the first and second cups 16*a*, 16*b*. The first and second detachably attachment means 162*a*, 162*b* typically comprise figure-of-eight loops similar to the loops 33*a*, 33*b* described hereinbefore. Further, the bridge means 152 comprises a flexible and preferably non-elastic material.

The foundation garment 110 comprises strap means 12. The strap means 12 comprises a first strap 112*a* and a second strap 112*b*.

Figure 15:
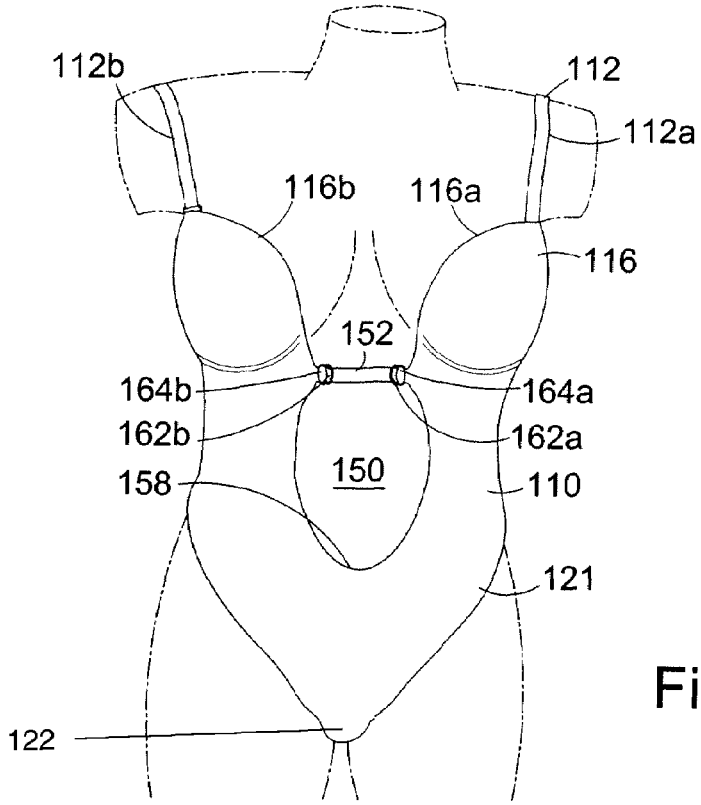
FIG. 15 a front view of the foundation garment of FIG. 14(*a*) in a first modification.
Figure 16:
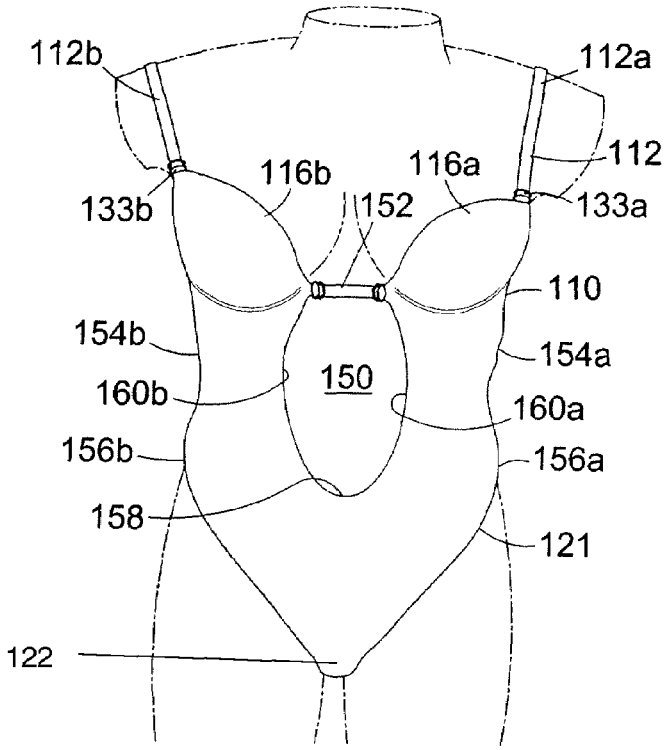
FIG. 16 a front view of the foundation garment of FIG. 14(*a*) in a second modification.
Figure 17:
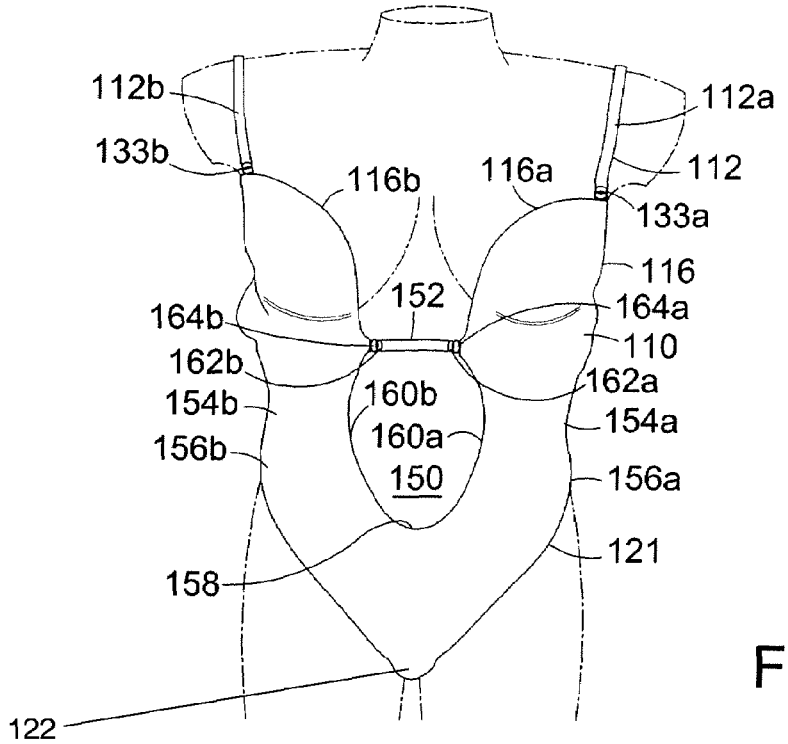
FIG. 17 a front view of the foundation garment of FIG. 14(*a*) in a third modification.
Figure 18:
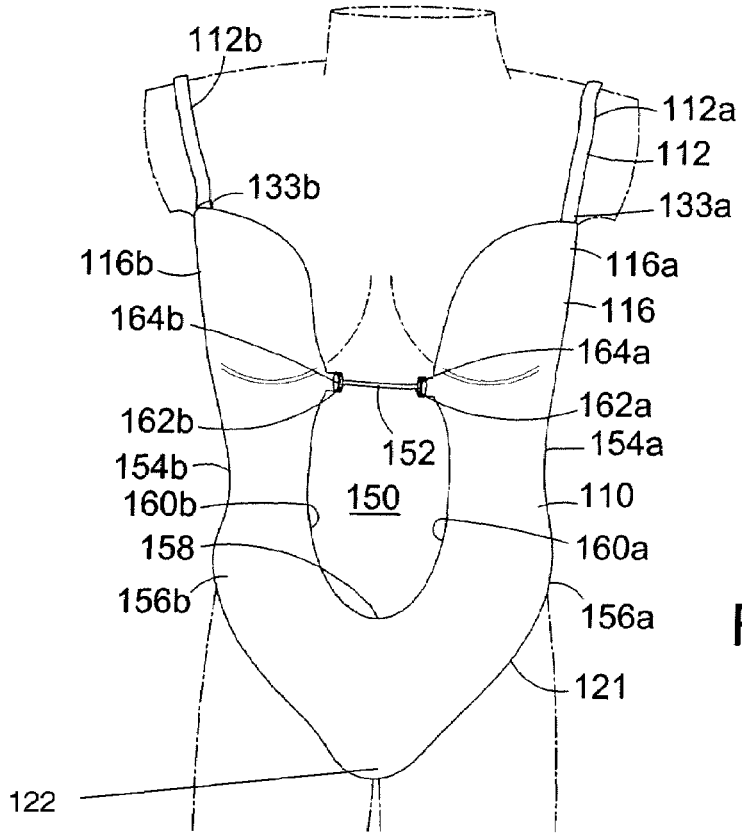
FIG. 18 a front view of the foundation garment of FIG. 14(*a*) in a fourth modification.

As can be seen from FIGS. 14(*a*) to 18 the bridge means 152 is selectable from one of: a flexible non-elasticated fabric, e.g. colour matched to a remainder of the foundation garment 110 (FIG. 14(*a*)); a flexible non-elasticated transparent material (FIG. 15 or 17); or a flexible non-elasticated material including diamante detailing (FIG. 18). Each bridge means 152 includes a hook or loop at each end thereof, for engagement with the attachment means 162*a*, 162*b*. Further, the straps 112*a*, 112*b* are selectable from: a flexible fabric, e.g. colour matched to a remainder of the garment 110 (FIGS. 14(*a*) to 14(*e*), 15 or 18); or a flexible transparent material (FIG. 16 or 17).

As can be seen from FIG. 14(*a*) to 14(*e*), the foundation garment 110 comprises: the breast support means 116 comprising the first and second cups 116*a*, 116*b*; first and second straps 112*a*, 112*b* first ends of which are attached to the first and second cups 116*a*, 116*b* respectively, and second ends of which are attached to first and second panels 154*a*, 154*b*, respectively, and wherein there are further provided first and second further straps 166*a*, 166*b*, a first end of each being attached to respective first and second side portions 154*a*, 154*b* of the garment 110 provided above the second end of the respective first and second straps 112*a*, 112*b*, and a second end of which is attached to the respective first and second straps 112*a*, 112*b*, at or near the second end thereof.

Provision of the first and second further straps 166*a*, 166*b* has been found to be beneficial in desirable positioning of the garment 110 and avoidance of gaping side portions thereof.

There are also provided means for adjusting a length of each of the first and second further straps 166*a*, 166*b*, and means such as figure-of-eight loops 168*a*, 168*b* for detachably attaching the first end of the first or second further straps 166*a*, 166*b* to the first or second side portions, respectively. In this embodiment the second end of the first or second further strap 166*a*, 166*b* is provided with a loop 170*a*, 170*b*, the respective first or second strap 112*a*, 112*b* passing through the respective loop 170*a*, 170*b*.

Various modifications may be made to the embodiment hereinbefore described without departing from the scope of the invention. For example, it will be appreciated that the straps 112*a*, 112*b* of the garment 110 may be changeably configurable in a similar manner to the straps 16*a*, 16*b*, 16*a*', 16*b*' of garments 10, 10'. Further, in the FIGS. 14(*a*) to 18, the garment 110 is shown having a thong style brief arrangement 121; however the brief arrangement 121 may instead be in the style of hotpants, full briefs, high leg briefs or similar.

Similarly the breast support means may be provided with pockets in which removable padding inserts can be inserted, wherein the inserts may be partially silicone gel filled bags laminated in fabric. However, the garment 110 need not be provided with such pockets, and may be worn without any additional padding. Alternatively the inserts may be permanently affixed into the garment. Also the inserts may be formed of foam, or as described may be partially filled bags; however these may be filled with fluids such as water, saline solution, or similar.

The silicone elastic which is used as friction providing means has been shown as a single strip stitched or optionally bonded to the fabric; however such need not be provided in a single strip and instead could be provided as a plurality of sections of silicone elastic, or in an extreme case, a plurality of dots of silicone elastic disposed around an inside edge of the garment.

It is also noted that the garment of the invention is described as having a two-way mesh lining provided for the front abdomen panel, however this mesh may be formed of other similar materials, and it may be the case that the garment of the invention is provided with no lining. Further, the garment of the invention may be formed of stretch satin, or other synthetic fabrics, and may include cotton content as opposed to the polyamide from which it is described as being formed. The first and second straps may be formed of a fixed length, however such may be formed in a manner which allows them to be adjusted in order to conform to an individual user and to accommodate for the different possible strap configurations used in a removable way. Also, it should be understood that the gusset panel, described as a single piece of fabric, may be formed of two parts fastened together using connectors such as poppers, studs, hook and loop fasteners (e.g. VELCRO (Trade Mark)), or the like.

The invention claimed is:

1. A foundation garment comprising:

breast support means comprising first and second cups;

brief means comprising first and second sides;

bridge means between the first and second cups;

a continuous front panel comprising first and second panel portions having respective edges, wherein the first and second panel portions extend from the respective first and second cups to the respective first and second sides of the brief means, wherein the continuous front panel further comprises a U-shaped portion connecting the first and second panel portions; and wherein there is provided a gap between the bridge means, an upper front edge of the brief means and respective edges of the first and second panel portions.

2. A foundation garment as claimed in claim 1, wherein the upper front edge of the brief means is below the navel of a wearer, when worn.

3. A foundation garment as claimed in claim 1, wherein the respective edges of the first and second panel portions are longitudinally extending.

4. A foundation garment as claimed in claim 1, wherein the first and second panel portions are each made of a flexible fabric.

5. A foundation garment as claimed in claim 1, wherein the bridge means has first and second ends, and there are provided first and second means for detachably attaching the first and second ends of the bridge means to the first and second cups.

6. A foundation garment as claimed in claim 1, wherein the bridge means comprises a flexible and non-elasticated material.

7. A foundation garment as claimed in claim 1, wherein the foundation garment comprises strap means which extend around a wearers neck or shoulder when worn, the strap means comprising a first strap or a first and second strap.

8. A foundation garment as claimed in claim 1, wherein the foundation garment is backless and no part of the foundation garment is provided, when worn between the nape of the neck, the lower small of the back and outer edges of the shoulder blades of a wearer.

9. A foundation garment as claimed in claim 7, wherein the breast support means comprises at least part of a front panel.

10. A foundation garment as claimed in claim 7, wherein the first strap means comprises at least a first strap, and the first strap is disposable relative to the breast support means so that the garment is wearable in a halter neck style, where the first strap extends around a wearers neck when worn.

11. A foundation garment as claimed in claim 7, wherein where the strap means comprises first and second straps, a first end of the first strap is affixable to a first cup and a second end of the first strap is affixable to a substantially vertical edge of the front panel in a position substantially below and adjacent an armpit of a wearer, and further a first end of the second strap is affixable to a second cup and a second end of the second strap is affixable to a vertical edge of the front panel in a position substantially below and adjacent another armpit of the wearer, such that said first strap and said second strap do not cross over one another.

12. A foundation garment as claimed in claims 9, 10 or 11, wherein there are provided means for detachably attaching the first and/or second straps the front panel.

13. A foundation garment as claimed in claim 1, wherein the brief means comprise a brief arrangement which extends between a wearers legs, when worn, and a back panel means.

14. A foundation garment as claimed in claim 1, wherein the foundation garment is an undergarment.

15. A foundation garment as claimed in claim 1, wherein the foundation garment comprises the front panel and a strap arrangement, wherein the front panel comprises the breast support means and at least two substantially vertical edges, and wherein friction providing means are disposed at least on an inner side of each substantially vertical edge of the front panel, wherein the friction providing means act, when worn, to prevent relative movement between the inner side of the respective vertical edge and flesh of a wearer.

16. A foundation garment as claimed in claim 15, wherein the friction providing means comprises first and second lengths of silicone elastic provided on inner sides of respective vertical edges.

17. A foundation garment as claimed in claim 15, wherein the friction providing means are disposed on at least an upper inside edge of the brief means adjacent the gap.

18. A foundation garment as claimed in claim 15, wherein the friction providing means are disposed on at least an inner side of each substantially vertical edge of each cup of the breast support means.

19. A foundation garment as claimed in claim 15, wherein the strap arrangement comprises at least a first strap.

20. A foundation garment as claimed in claim 19, wherein a first end of the first strap can be affixed at or near to an upper edge of the breast support means and a second end of the first strap can also be affixed to an upper edge of the said breast support means.

21. A foundation garment as claimed in claim 19, wherein there are provided means for removably affixing said first strap to the foundation garment.

22. A foundation garment as claimed in claim 15, wherein the strap arrangement comprises a first strap and a second strap.

23. A foundation garment as claimed in claim 22, wherein a first end of the first strap can be affixed to the breast support means and a second end of the first strap can be affixed to one of the substantially longitudinal or vertical edges of the front panel and further, a first end of the second strap can be affixed to the breast support means and a second end of the second strap can be affixed to the other of the substantially vertical edges of the front panel.

24. A foundation garment as claimed in claim 22, wherein there is provided means for removably affixing said first and second straps to the foundation garment.

25. A foundation garment as claimed in claim 22, wherein said first strap and said second strap do not cross over one another.

26. A foundation garment as claimed in claim 22, wherein said first strap and said second strap cross over one another.

27. A foundation garment as claimed in claim 1, wherein the foundation garment comprises the front panel and a strap arrangement wherein the strap arrangement comprises a first strap and a second strap, a first end of the first strap and a first end of the second strap being attached to the front panel, and a second end of the first strap and a second end of the second strap being attached to respective sides of the front panel, such that the first strap does not cross over the second strap.

28. A foundation garment as claimed in claim 27, wherein said first strap and said second strap are permanently affixed to the front panel arrangement.

29. A foundation garment as claimed in claim 27, wherein there are provided means for removably affixing said first strap and said second strap to said front panel arrangement.

30. A foundation garment as claimed in claim 29, wherein the removably affixable first strap and removably affixable second strap are arrangeable such that the first strap and second strap do cross over.

31. A foundation garment as claimed in claim 27, wherein the straps are formed of a same fabric as the front panel and the brief means.

32. A foundation garment as claimed in claim 27, wherein the front panel comprises the breast support means.

33. A foundation garment as claimed in claim 7, wherein the strap means are formed of a substantially transparent material.

34. A foundation garment as claimed in claim 27, wherein the brief means comprises a gusset which extends between legs of wearers, when worn, the gusset being affixed to the front panel arrangement and a rear panel arrangement affixed at a first edge to the gusset, at a second edge attached to a first lower vertical edge of the front panel, and at a third edge attached to a second vertical edge of the front panel.

35. A foundation garment as claimed in claim 34, wherein an inner side of each substantially vertical edge of the front panel is provided with a friction providing means.

36. A foundation garment as claimed in claim 35, wherein an inner side of an upper edge of the rear panel arrangement is provided with another friction providing means.

37. A foundation garment as claimed in claim 35, wherein the friction providing means is silicone elastic.

38. A foundation garment as claimed in claim 1, wherein each cup of the breast support means is provided with an underwire arrangement.

39. A foundation garment as claimed in claim 1, wherein each cup of the breast support means is a seam free cup.

40. A foundation garment as claimed in claim 1, wherein the foundation garment comprises the front panel arrangement and a strap arrangement comprising a first strap and a second strap, wherein when worn the first strap substantially encircles an acromio-clavicular joint of one side of a wearer and the second strap substantially encircles the acromio-clavicular joint of another side of the wearer.

41. A foundation garment as claimed in claim 40, wherein the first strap is arranged to substantially encircle the acromio-clavicular joint of a right hand side of the wearer by having a first end of the first strap attached at or near to a right hand side upper edge of the front panel and a second end of the first strap attached to a right hand side vertical edge of the panel at a point below an armpit of the wearer.

42. A foundation garment as claimed in claim 40, wherein the second strap is arranged to substantially encircle the acromio-clavicular joint of a left hand side of the wearer by having a first end of the second strap attached at or near to a left hand side upper edge of the front panel and a second end of the second strap attached to a left hand side vertical edge of the front panel arrangement at a point below an armpit of the wearer.

43. A foundation garment as claimed in claim 1, wherein the first and/or second straps are interchangeably selectable from one of: a flexible fabric, or a flexible transparent material.

* * * * *